United States Patent [19]

Stanish

[11] 4,052,580

[45] Oct. 4, 1977

[54] MOMENTARY CONTACT PUSHBUTTON TYPE SWITCH HAVING FLEXIBLE, MOUNTED HOUSING

[75] Inventor: Ronald J. Stanish, Hollywood, Fla.

[73] Assignee: AMF Incorporated, White Plains, N.Y.

[21] Appl. No.: 726,095

[22] Filed: Sept. 24, 1976

Related U.S. Application Data

[63] Continuation-in-part of Ser. No. 583,466, June 3, 1975, Pat. No. 3,983,341.

[51] Int. Cl.[2] ..... H01H 13/52

[52] U.S. Cl. ..... 200/159 R; 200/16 A; 200/159 A; 200/243; 200/275; 200/295; 200/303

[58] Field of Search ..... 200/16 A, 16 C, 16 D, 200/60, 239, 241, 242, 243, 159 R, 159 A, 159 B, 5 A, 275, 292, 295, 302, 303, 340, 336

[56] References Cited

U.S. PATENT DOCUMENTS

| | | | |
|---|---|---|---|
| 3,185,803 | 5/1965 | Driscoll | 200/159 A |
| 3,377,454 | 4/1968 | Faggiano | 200/295 |
| 3,525,828 | 8/1970 | Eckhart et al. | 200/16 D |
| 3,592,983 | 7/1971 | Kroll et al. | 200/16 D |
| 3,808,389 | 4/1974 | Ramsay et al. | 200/159 A |
| 3,917,917 | 11/1975 | Murata | 200/5 A |
| 3,928,741 | 12/1975 | Comer | 200/159 R |
| 3,967,085 | 6/1976 | Lockard | 200/159 B X |
| 3,983,341 | 9/1976 | Stanish | 200/16 D |

*Primary Examiner*—James R. Scott
*Attorney, Agent, or Firm*—George W. Price; John H. Gallagher

[57] ABSTRACT

A momentary contact push switch comprising a thin terminal board having spaced stationary contacts on a narrow intermediate region thereof. A bridging contact is positioned on the underside of a unitary plastic housing member. The housing member includes integral yieldable side skirts that extend downwardly from opposite sides and below opposite side edges of the intermediate region of the terminal board. Inwardly extending barbs or latch elements on the bottoms of both side skirts snap under the edges of the terminal board and hold the housing on the terminal board. Spring means extending between the terminal board and the bridging contact hold the bridging contact and housing member above the stationary contacts. A downward force on the housing member overcomes the spring force and brings the bridging contact into contact with spaced stationary contacts.

12 Claims, 9 Drawing Figures

FIG. 4
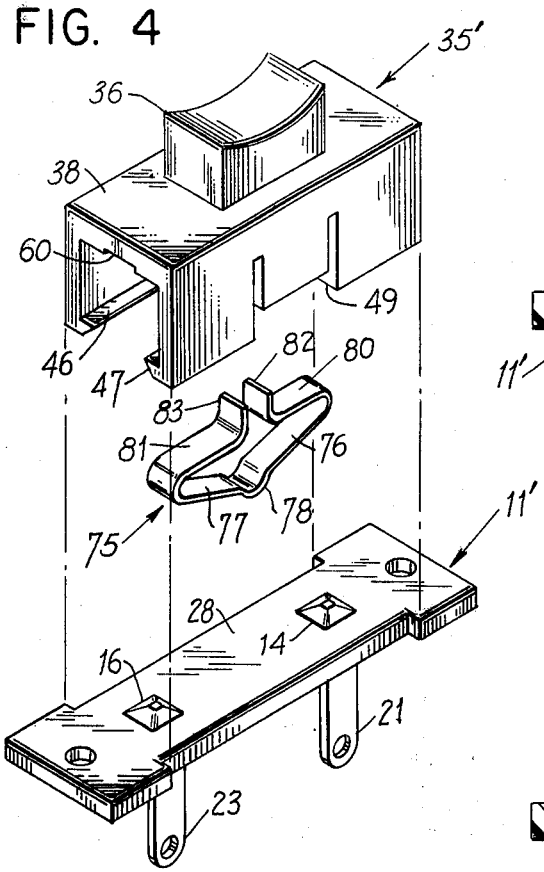
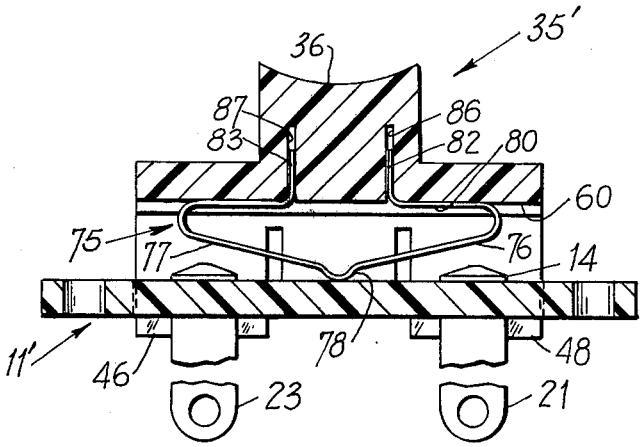
FIG. 4a
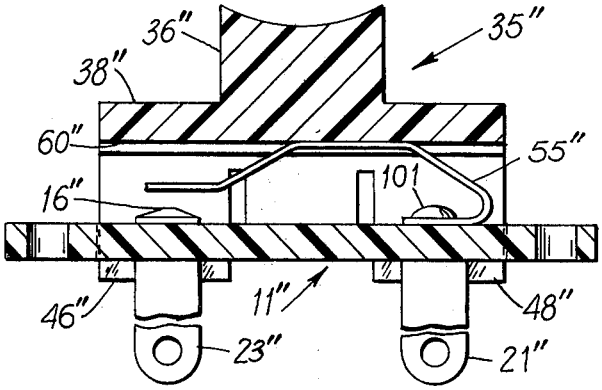
FIG. 6
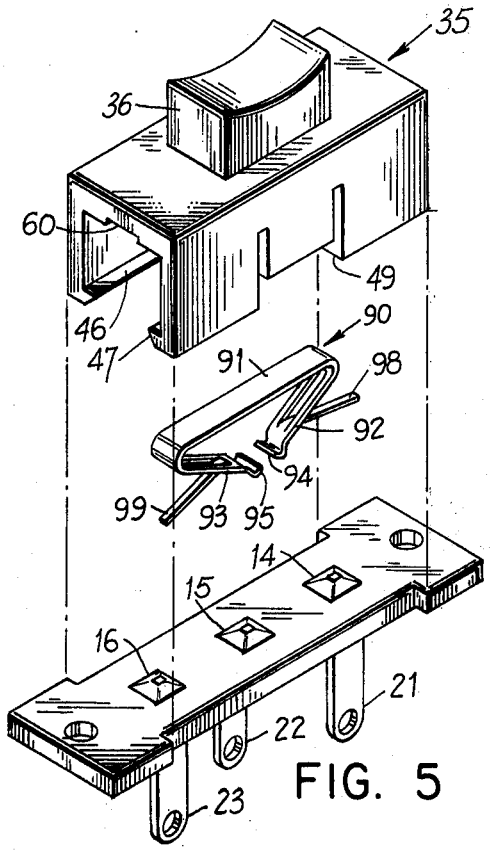
FIG. 5
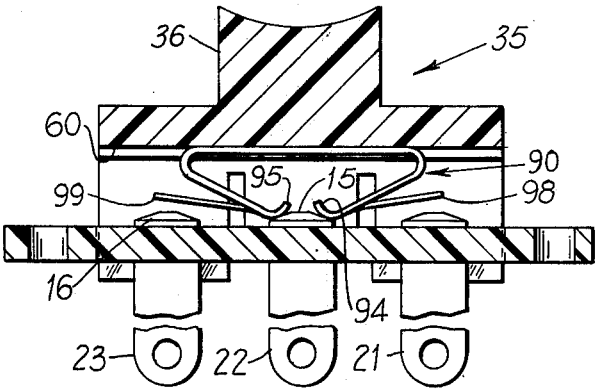
FIG. 5a

MOMENTARY CONTACT PUSHBUTTON TYPE SWITCH HAVING FLEXIBLE, MOUNTED HOUSING

RELATED APPLICATION

This application is a continuation-in-part of my copending application Ser. No. 583,466, filed June 3, 1975 entitled Simplified Slide Switch, now U.S. Pat. No. 3,983,341.

BACKGROUND OF THE INVENTION

In my copending application referred to above, I disclosed a simplified slide switch in which a unitary molded housing member includes a horizontal top portion within which is retained a sliding contact spring member. The top portion spans the narrow intermediate portion of an I-shaped terminal board on which are mounted a plurality of stationary contacts that are selectively bridged by the sliding contact. The housing includes thin, yieldable side skirts which extend downwardly from opposite sides of the housing and adjacent the opposite sides of the narrow intermediate portion of the terminal board. The bottoms of the side skirts have inwardly extending barbs which slidingly engage the undersides of the edges of the intermediate portion of the terminal board, thus holding the housing on the base member and permitting sliding motion therebetween. The terminal board includes mounting means for mounting the switch on appliances or other apparatus.

SUMMARY OF THE PRESENT INVENTION

I have discovered that I may apply the principles of my above-described slide switch to a momentary push switch and, in fact, may use some parts of the two switches interchangeably.

BRIEF DESCRIPTION OF THE DRAWINGS

FIGS. 4 and 5 are exploded views of further momentary push switch embodiments FIGS. 4*a*, 5*a* and 6 are cross-sectional views of further momentary push switch embodiments constructed in accordance with the principles of this invention.

DESCRIPTION OF PREFERRED EMBODIMENT

Figure 1:
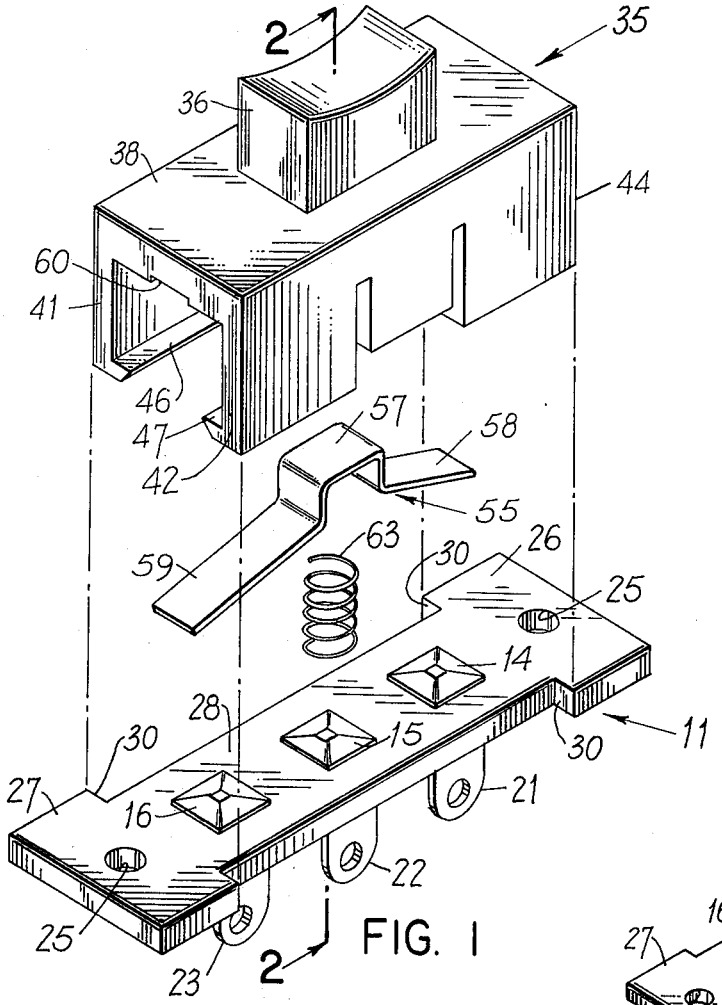
FIG. 1 is an exploded view of the momentary push switch of the present invention.
Figure 2:
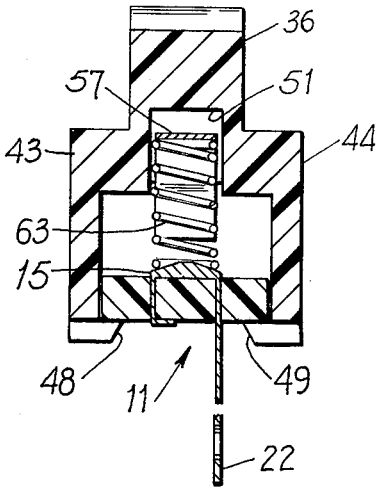
FIG. 2 is a cross sectional view of an assembled switch of this invention taken at section 2—2 of FIG. 1.
Figure 1A:
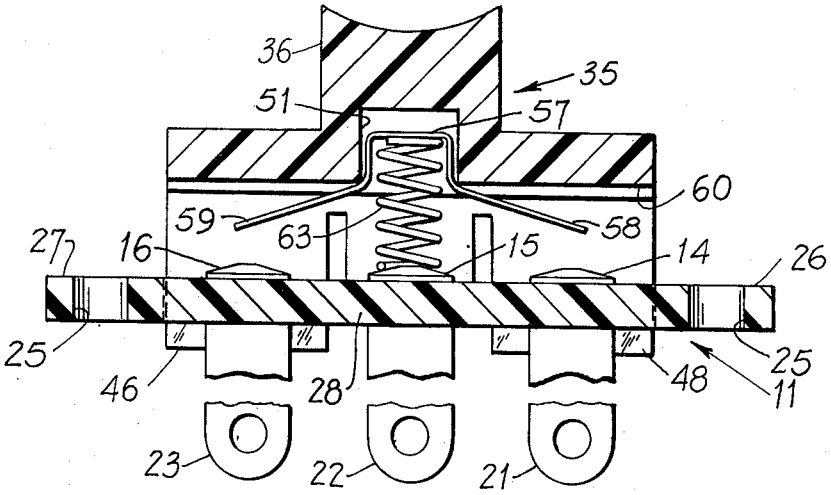
FIG. 1*a*is a side sectional view of the switch illustrated in FIG. 1.

Referring in detail to FIGS. 1, 1*a*, and 2, the momentary contact switch of this invention is comprised of a thin base or terminal board member 11 of insulating material having aligned and spaced apart stationary contacts, 14, 15 and 16 extending upwardly from the top surface of the terminal board. Connector terminals 21, 22 and 23 are integral with the contacts 14–16 and extend through terminal board 11 to provide external connector means extending from the bottom of terminal board 11. Mounting holes 25 are provided at respective end regions 26 and 27 of terminal board 11. It is seen that the thin base or terminal board is generally I-shaped with the end regions 26 or 27 wider than the intermediate region 28 on which the contacts 14–16 are located. Right angle shoulders 30 are provided where the intermediate region 28 meets the end regions 26 and 27. These shoulders serve to help position and maintain the housing member on terminal board 11, as will be described.

Housing member 35 is molded as a unit from a plastic insulating material and is comprised of an actuator button 36 extending upwardly from a horizontal top portion 38 which is wider than, and spans, the intermediate portion 28 of terminal board 11. The vertical sides of housing member 35 are comprised of thin, yieldable side skirts which may be continuous throughout their lengths, or may be segmented as illustrated in FIG. 1. In the embodiment illustrated in FIGS. 1 and 2, the end segments 41, 42, 43 and 44 of the opposite side skirts have inwardly extending barbs or latch elements 46, 47, 48, 49 that are adapted to engage the underside of opposite edges of the intermediate region 28 of terminal board 11 to hold housing member 35 in engagement with the terminal board. The lower interior surfaces of the barbs 46–47 are inclined upwardly and inwardly.

As best seen in FIG. 2, a recess 51 is molded into the underside of top horizontal portion 38 and extends up into the interior of actuator button 36.

The movable contact of the switch is a bridging contact spring member 55 which has a generally U-shaped central portion 57 and outwardly extending, wing-like end portions 58 and 59 that extend outwardly over the respective stationary contacts 14 and 16. The underside of top horizontal portion 38 also has molded therein a shallow slot 60 that extends substantially the length of the housing member. This shallow slot 60 at least partially receives the wing-like end portions 58 and 59 of bridging contact 55 and maintains the contact aligned in its illustrated front and aft position.

A helical spring 63 of electrical conducting material has its top end received within and contacting the central U-shaped portion of bridging contact 55. The bottom end of helical spring 63 is seated on dome-shaped center stationary contact 15 on terminal board 11.

In the assembled and unactuated condition of the switch of this invention, spring 63 maintains the U-shaped central portion 57 of bridging contact 55 up within the recess 51 in the underside of housing 35, and exerts an upward force that acts against the bridging contact, and in turn against housing member 35, to lift them upwardly together. The barbs 46–49 at the bottoms of the end segments 41–44 of the side skirts are brought into firm contact with the underside of the intermediate portion 28 of terminal board 11 to hold housing member 35 in its uppermost position. In this position, wing-like end portions 58 and 59 of bridging contact 55 are above and out of contact with respective stationary contacts 14 and 16. The vertical heights of the end segments 41–44 of the side skirts are proportioned to assure that housing member 35 and bridging contact 55 are raised sufficiently high above terminal board 11 so that the contacts are reliably maintained in the electrical open condition.

The longitudinal length of housing member 35 is chosen so that the opposite ends thereof are substantially butting against the shoulders 30 at opposite ends of the intermediate region 28 of terminal board 11, thereby to prevent longitudinal motion of housing member 35 relative to the terminal board, but permitting relative vertical motion therebetween.

To actuate the switch to its contacts closed position, the operator pushes downwardly on actuator button 36 to overcome to force of helical spring 63 and to move housing 35 vertically downwardly. All the barbs 46–49 become disengaged from terminal board 11 and the downward motion continues until the wing-like end portions 58 and 59 of bridging contact 55 make contact with respective stationary contacts 14 and 16 on terminal board 11. The electrical conductive path thus established is as follows. From center connector terminal 22 through center stationary contact 15 to helical spring 63, through the center portion 57 of the bridging contact 55 to each of the wing-like end portions 58 and 59 to the respective end stationary contacts 14 and 16, and then to the respective end connector terminals 21 and 23. End connector terminals 21 and 23 may be wired to, or otherwise connected to, separate circuit paths, or they may be connected in parallel to the same circuit path. The latter connection is advantageous because housing member 35 may become somewhat tilted during its downward movement and one of the end portions 58 and 59 of bridging contact 55 may contact its respective stationary contact before the other one. By connecting connector terminals 21 and 23 in parallel, the switch is in its closed condition as soon as the first one of the end portions 58 or 59 contacts its corresponding stationary contact.

To assemble the switch illustrated in FIGS. 1 and 2, housing member 35 is turned upside down and the central U-shaped portion 57 of bridging contact 55 is inserted within recess 51 in the housing member. The wing-like end portions 58 and 59 of the bridging contact are aligned in shallow slot 60 and helical spring 63 is dropped into the U-shaped portion of the bridging contact. One edge of the intermediate region 28 of terminal board 11 then is slipped under the barbs 46 and 48, for example, on one side of the side skirts and the free end of helical spring 63 is placed over the raised center stationary contact 15. The opposite edge of the intermediate portion 28 of terminal board 11 then is placed against the sloping bottom surface of the barbs 47 and 49 and a force is applied to that free edge. Because the barbed segments of the side skirts are relatively thin and yieldable, they flex outwardly and allow the terminal board to snap into place under the remaining two barbs. Helical spring 63 then will maintain housing member 35 in its raised position in which barbs 46–49 are in engagement with the underside of the intermediate portion of terminal board 11.

Figure 3:
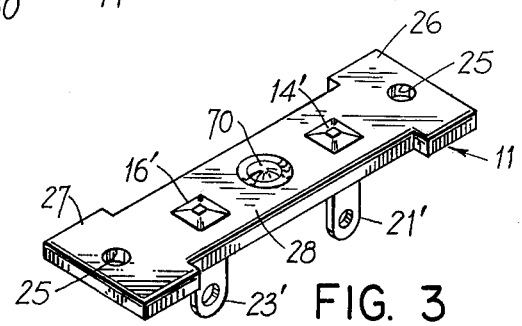
FIG. 3 is an alternative embodiment of the base or terminal board of the present invention.

FIG. 3 is an illustration of an alternative arrangement of stationary contacts on terminal board 11. In this embodiment there are only two stationary contacts 14' and 16'. These contacts correspond to end contacts 14 and 16 in FIG. 1. Connector terminals 21' and 23' provide external connector means for stationary contacts 14' and 16'. There is no center stationary contact on the terminal board 11 of FIG. 3, but in its place is formed directly on the terminal board surface, as by stamping, embossing or molding, a dome-shaped element 70 upon which the bottom end of helical spring 63 may be seated. The remaining parts of the switch would be identical to those illustrated in FIG. 1.

In the operation of a switch having the two stationary contacts illustrated in FIG. 3, upon depression of the unitary housing 35, bridging contact 55 will directly engage and establish conductive contact between the stationary contacts 14' and 16'.

A further embodiment that would result in the electrical equivalent of a switch that utilized a terminal board illustrated in FIG. 3 would be the switch illustrated in FIG. 1, but with the center connector terminal 22 cut off substantially flush with the bottom surface of terminal board 11.

The switch embodiments described above are single pole-single throw switches. It is obvious that other switching functions may be provided in a switch constructed in accordance with the teachings of this invention. For example, pairs of side-by-side stationary contacts, with accompanying connector terminals, may be provided instead of the single contacts illustrated in FIGS. 1–3 to provide a double pole-single throw switching function, or a redundant single pole-single throw function.

The base or terminal board 11 illustrated in FIGS. 1 and 3 may be the same as used in the slide switch disclosed in my copending application referred to above. In the slide switch embodiment the housing member corresponding to housing member 35, FIG. 1, would be shorter in the direction along the length of intermediate region 28 to permit the housing member and sliding contact to slide along the intermediate region between shoulders 30 to selectively engage different stationary contacts. This interchangeability of base or terminal boards minimizes the costs of tooling and production.

In the switches described above, the bridging contact spring member 55 and helical spring 63 are separate elements that serve separate functions. In accordance with the principles of this invention, a single spring means may be provided to perform both functions. In FIGS. 4 and 4*a*, for example, spring 75 is formed of a thin, flat, electrically conductive spring metal having inclined bottom arms 76 and 77 which meet at a vertex in the form of a convex boss 78. The spring includes generally horizontal arms 80 and 81 which extend inwardly toward each other from the ends of the inclined arms 76 and 77. Spaced upstanding tabs 82 and 83 form the top of spring 75.

Housing member 35' includes in its underside two narrow slots 86 and 87 for receiving tabs 82 and 83 therein in a force fit, for example.

Terminal board 11' includes the spaced stationary contacts 14 and 16 and their corresponding connector terminals 21 and 23.

In the assembled condition, spring 75 is retained by housing member 35' by means of the tabs 82 and 83 being seated within narrow slots 86 and 87. Housing member 35' is snapped onto the intermediate region 28 of terminal board 11' so that the barbs or latch elements 46, 47, 48 (not visible) and 49 are in engagement with the underside of the terminal board in the manner described above.

Boss 78 of spring member 75 rests on the top surface of terminal board 11' at a region between stationary contacts 14 and 16. In the unactuated condition of the switch, the bottom arms 76 and 77 incline upwardly and outwardly over, and out of physical and electrical contact with, the stationary contacts 14 and 16. The switch is in its open condition when unactuated.

Upon the application of a downwardly directed force to housing member 35', barbs 46–49 become disengaged from the underside of terminal board 11' and housing member 35' moves toward the terminal board. Spring member 75 compresses in the vertical direction and the inclined arms 76 and 77 bend down and come into contact with stationary contacts 14 and 16, thereby electrically bridging them.

Upon removal of the vertically directed force to housing member 35', the energy stored in spring 75 restores the spring to its initial shape, thereby raising housing member 35' upwardly until barbs 46–49 engage terminal board 11', and also lifting inclined arms 76 and 77 upon and out of contact with the stationary contacts 14 and 16.

Boss 78 at the bottom or vertex of spring 75 is illustrated as being downwardly convex and adapted to contact the surface of insulator terminal board 11'. Alternatively, the boss 78 may have an opposite curvature, i.e., concave. In that case, the concave boss at the vertex of spring 75 could be seated on a center one of three spaced stationary contacts, such as stationary contact 15 on the terminal board of 11 of FIG. 1. Then upon actuation of the switch, the inclined bottom arms 76 and 77 would contact stationary contacts 14 and 16. Electrically, such an arrangement would be equivalent to the switch of FIG. 1. Again, a common terminal board could be used for both embodiments.

FIGS. 5 and 5*a* illustrate a further alternative embodiment using but a single spring member that also serves as the bridging contact.

Housing member 35 and terminal board 11 each may be substantially identical to corresponding parts illustrated in FIG. 1. Electrically conductive spring member 90 includes a flat horizontal top portion 91 that is adapted to be received within the slot 60 that extends lengthwise along the underside of housing member 35. Downwardly and inwardly inclined arms 92 and 93 extend from opposite ends of top portion 91 and terminate in upwardly inclined, spaced tabs 94 and 95. Tabs 94 and 95 are adapted to be seated on the center stationary contact 15 on terminal board 11. The inclined arms 92 and 93 of spring member 90 include respective cut outs 98 and 99 that are wing-like and extend outwardly over the stationary contacts 14 and 16.

In the assembled and unactuated condition of the switch of FIGS. 5 and 5*a*, housing member 35 is attached to terminal board 11 by means of barbs 46–49 in the manner previously explained. Spring 90 is held in position between the slot 60 in housing member 35 and the stationary contact 15 on terminal board 11. Wing-like cut outs 98 and 99 are physically and electrically out of contact with stationary contacts 14 and 16. Spring 90 is shaped and proportioned to hold housing member 35 at its highest possible position, whereby barbs 46–49 are up against the underside of terminal board 11.

Upon the application of a downwardly directed force to housing member 35 it moves toward terminal board 11 and causes spring 90 to become flatter in configuration to the extent that wing-like cut outs 98 and 99 come into physical and electrical contact with stationary contacts 14 and 16. Center stationary contact 15 then is electrically connected to the end stationary contacts 14 and 16.

As in the case of the embodiment of FIG. 3, the center stationary contact 15 in FIG. 5 could be removed from terminal board 11 and bridging contact spring member 90 would establish electrical contact between the remaining stationary contacts 14 and 16.

Another embodiment of the simplified momentary contact push switch of this invention is illustrated in the cross sectional illustration of FIG. 6. Housing member 35" is a unitary molded plastic member that is similar to that of FIG. 1 except that there is no recess in the underside of the horizontal top portion 38". The narrow slot or groove 60" may extend the length of the housing member.

Housing member 35" includes yieldable side skirts on opposite sides thereof and, as previously described, the side skirts include at their bottom portions the inwardly extending barbs or latch elements, the barbs 46" and 48" being the only ones illustrated in the sectional view of FIG. 6. These barbs engage the underside of the intermediate region of terminal board 11" and hold the housing member 35" on the terminal board.

In this embodiment, terminal board 11" has two connector terminals 21" and 23" extending from the bottom surface. Connector terminal 23" is associated with stationary contact 16" on the top surface of the board, and connector terminal 21" provides electrical connection to a stationary contact in the form of a rivet head 101 on the top surface of the board. Other fastening and construction arrangements may be used in place of rivet 101.

A yieldable and movable spring contact member 55" made of a thin flat conductive material has one end fastened to rivet 101 and its opposite free end fashioned to form a contact for making contact with stationary contact 16". The mid region of movable contact 55" has a somewhat U-shaped bend therein which is in contact with groove 60" in the underside of housing member 35".

In the unactuated condition of the switch the movable spring contact 55" biases the horizontal top portion 38" of the housing member upwardly away from the top surface of the terminal board and causes the barbs 46", 48", and others, to engage the underside of the terminal board. In this condition the free end of movable spring contact 55" is out of physical contact with stationary contact 16" so that the switch is in its open condition.

Upon actuation of the switch by applying a downwardly directed force to housing member 35", the housing member moves down and the barbs disengage from the underside of terminal board 11". The free end of movable spring contact 55" makes contact with stationary contact 16" to establish electrical continuity between connector terminals 21" and 23". Upon termination of the applied force, the energy stored in spring contact member 55" returns the switch to its unactuated condition.

From the above description it may be seen that momentary contact push switches constructed as described require a minimum number of parts that do not include a metal housing, are simple to manufacture and assemble, and provide the desirable feature of interchangeability of parts for different configurations of switches.

In its broader aspects, this invention is not limited to the specific embodiments illustrated and described. Various changes and modifications may be made without departing from the inventive principles herein disclosed.

What is claimed is:

1. A momentary contact push switch comprising
a thin insulator terminal board having two end regions and an intermediate region therebetween,
a plurality of stationary contacts on one surface of the terminal board in said intermediate region,
terminal means for said stationary contacts,
a housing member formed as a unitary plastic piece having a top portion that extends transversely across the intermediate region of the terminal board and including yieldable side skirts that extend downwardly below opposite side edges of the intermediate region of the terminal board, one or more barbs or latch elements at the lower portions of the skirts, said barbs extending inwardly of the side edges of the intermediate region for releasably engaging the underside of the terminal board, a bridging contact disposed against the underside of the top portion of said housing member for establishing electrical connection between given stationary contacts on the terminal board, spring means extending between said terminal board and housing member for maintaining the top portion of the housing member raised above the terminal board and for maintaining the bridging contact above and out of contact with the stationary contacts, said barbs on the skirts holding the housing member on the terminal board and limiting the separation of the top portion of the housing member above the terminal board, the top portion of said housing member and said bridging contact being movable toward said terminal board upon application of a force thereto that is directed substantially normal to the surface of the terminal board, all of said barbs becoming disengaged from the underside of the intermediate region of the terminal board and said bridging contact engaging said given stationary contacts after a given distance of motion of the housing member toward the terminal board.

2. The combination claimed in claim 1 wherein said end regions of the terminal board are wider than the intermediate region and the joinder of said regions being characterized by a relatively abrupt change in width, said housing member extending substantially the length of said intermediate region and being prevented from substantial movement along the length of the intermediate region by the abrupt changes in width of the terminal board.

3. The combination claimed in claim 1 wherein said stationary contacts are aligned in spaced apart relationship along the length of the intermediate region of the terminal board, said bridging contact extending in a direction parallel to the length of the intermediate region for bridging given ones on the aligned stationary contacts.

4. The combination claimed in claim 3 wherein said bridging contact includes a U-shaped central portion with the open end extending from the underside of the housing member, said bridging contact further including a wing-like end portion extending outwardly from each leg of the U-shaped central portion, said end portions of the bridging contact extending toward opposite ends of said intermediate region and disposed above given stationary contacts.

5. The combination claimed in claim 4 wherein said spring means is a helical spring having one end received within said U-shaped central portion of the bridging contact.

6. The combination claimed in claim 5 wherein the opposite end of the helical spring is in contact with a stationary contact on the terminal board and is made of electrical conducting material to provide a conduction path to said bridging contact.

7. The combination claimed in claim 5 wherein the opposite end of the helical spring is in contact with said insulator terminal board at a region between stationary contacts.

8. A momentary contact push switch comprising a thin insulator terminal board having a narrow intermediate region and wider opposite end regions, said intermediate region joining the end regions with an abrupt change in width dimension, a plurality of stationary contacts extending from one surface of the terminal board and disposed and arranged in spaced apart relationship along said intermediate region, a plurality of terminal means for said stationary contacts, a housing member formed as a unitary piece of insulating material having a horizontal top portion that extends transversely across and longitudinally along the intermediate region of the terminal board, said housing member including yieldable side skirts that extend downwardly and beyond the side edges of the intermediate region of the terminal board, one or more barbs or latch elements at the lower portion of each of said side skirts, said barbs extending inwardly of the side edges of the intermediate region for engaging the underside of the terminal board, a bridging contact retained on the underside of the horizontal portion of said housing member and disposed above given stationary contacts on the terminal board, said bridging contact including a wing-like portion extending from each leg of a U-shaped central portion, said wing-like portions being disposed above respectively ones of the stationary contacts, a helical spring member having one end on said terminal board and its opposite end contacting the U-shaped portion of the bridging contact for maintaining said bridging contact and the horizontal portion of the housing member spaced above the stationary contacts, said barb on the skirts holding the housing member on the terminal board and limiting the separation of the housing member above the terminal board, said housing member and bridging contact being movable toward said terminal board upon application of a force thereto that is directed normal to the surface of the terminal board, all of said barbs becoming disengaged from the underside of the intermediate region of the terminal board and said bridging contact engaging given stationary contacts after a given distance of motion of the housing member toward the terminal board.

9. The combination claimed in claim 8 wherein said one end of the helical spring is in contact with one of said stationary contacts and is made of electrical conducting material to provide a conduction path to said bridging contact.

10. The combination claimed in claim 8 wherein said one end of said helical spring is in contact with said insulator terminal board at a region between two stationary contacts.

11. A momentary contact push switch comprising a thin insulator terminal board having two end regions and an intermediate region therebetween, a plurality of stationary contacts on one surface of the terminal board in said intermediate region, terminal means for said stationary contacts, a housing member formed as a unitary plastic piece having a top portion that extends transversely across the intermediate region of the terminal board and including yieldable side skirts that extend downwardly below opposite side edges of the intermediate region of the terminal board, one or more barbs or latch elements at the lower portions of the skirts, said barbs extending inwardly of the side edges of the intermediate region for releasably engaging the underside of the terminal board, means for spring biasing said top portion of the housing member in spaced relationship above said terminal board and for maintaining said barbs or latch elements in releasable contact against the underside of the terminal board, said barbs on the skirts holding the housing member on the terminal board and limiting the separation of the top portion of the housing member above the terminal board, the top portion of said housing member being movable toward said terminal board upon application of a force thereto that is directed substantially normal to the surface of the terminal board, means for selectively establishing an electrical connection between given stationary contacts in response to movement of the top portion of the housing member a given distance toward the terminal board, all of said barbs becoming disengaged from the underside of the intermediate region of the terminal board after the housing member begins moving toward the terminal board.

12. The combination claimed in claim 11 wherein said means for spring biasing said top portion of the housing member and said means for selectively establishing an electrical connection between given stationary contacts are comprised of a single spring means that extends between the housing member and terminal board to maintain the top portion of the housing member in spaced relationship above the terminal board and that bridges given stationary contacts when the housing member is moved said given distance toward the terminal board.

* * * * *